US007525404B2

(12) United States Patent
Larimore et al.

(10) Patent No.: US 7,525,404 B2
(45) Date of Patent: Apr. 28, 2009

(54) MOISTURE EXHAUSTING MEMBRANE IN ELECTRICAL SOLENOID

(75) Inventors: Richard Larimore, Daleville, IN (US); James Gillett, Fountaintown, IN (US); Dong Ju Park, Fishers, IN (US)

(73) Assignee: Remy Inc., Anderson, IN (US)

( * ) Notice: Subject to any disclaimer, the term of this patent is extended or adjusted under 35 U.S.C. 154(b) by 863 days.

(21) Appl. No.: 10/921,160

(22) Filed: Aug. 19, 2004

(65) Prior Publication Data

US 2006/0038644 A1 Feb. 23, 2006

(51) Int. Cl.
*H01F 7/00* (2006.01)

(52) U.S. Cl. ..... 335/278; 335/126; 335/260; 335/292; 335/300; 290/47; 290/48; 74/6

(58) Field of Classification Search ..... 335/260, 335/278, 292, 300, 126; 290/47–48; 74/6
See application file for complete search history.

(56) References Cited

U.S. PATENT DOCUMENTS

| | | | | | |
|---|---|---|---|---|---|
| 2,694,165 | A * | 11/1954 | Trombetta | 335/260 |
| 3,775,714 | A * | 11/1973 | Heuer | 335/230 |
| 3,778,719 | A | 12/1973 | Kanawa | |
| 4,782,671 | A * | 11/1988 | Breneman et al. | 62/51.1 |
| 4,990,054 | A * | 2/1991 | Janocko | 415/111 |
| 5,126,712 | A * | 6/1992 | Sugiyama | 335/278 |
| 5,220,301 | A | 6/1993 | Haas et al. | |
| 5,650,677 | A * | 7/1997 | Furukawa et al. | 310/88 |
| 5,878,779 | A * | 3/1999 | Bircann et al. | 137/554 |
| 6,062,536 | A | 5/2000 | Bircann | |
| 6,260,664 | B1 * | 7/2001 | Fieffer | 184/7.4 |
| 6,420,950 | B1 | 7/2002 | Kleinert et al. | |
| 6,538,543 | B2 * | 3/2003 | Bircann et al. | 335/220 |
| 6,849,179 | B1 * | 2/2005 | Taylor et al. | 210/223 |
| 6,932,356 | B2 * | 8/2005 | Gloaguen | 277/636 |
| 2004/0041058 | A1 * | 3/2004 | Woessner et al. | 244/3.1 |

FOREIGN PATENT DOCUMENTS

JP 08236953 A 9/1996

* cited by examiner

*Primary Examiner*—Elvin G Enad
*Assistant Examiner*—Mohamad A Musleh
(74) *Attorney, Agent, or Firm*—Finnegan, Henderson, Farabow, Garrett & Dunner, L.L.P.

(57) ABSTRACT

A vent assembly is provided for allowing internal contaminants to exit a solenoid. The vent assembly includes a vent membrane interposed between a gasket and a support. The support may have a variable diameter. The vent assembly attaches to the solenoid via a mating cover of the solenoid, which includes a vent opening that aligns with an opening in the gasket and includes a counter bore that captures the gasket. The vent assembly allows contaminants to exit the solenoid through a vent membrane. It also prevents contaminants from entering the solenoid around the vent membrane without the use of injection molding.

17 Claims, 6 Drawing Sheets

MOISTURE EXHAUSTING MEMBRANE IN ELECTRICAL SOLENOID

TECHNICAL FIELD

The present invention generally relates to electro-mechanical systems and, more particularly, to a vent assembly suitable for use with an electro-mechanical solenoid. In one example, methods and systems of the present invention may be utilized to eliminate contaminants, such as water vapor and other atmospheric gases, from within the solenoid, and thus eliminate contaminant condensation on internal solenoid surfaces.

BACKGROUND

Electro-mechanical solenoids are used in many applications. A solenoid is an inductor, usually composed of a cylindrical or toroidal core surrounded by a coil. The core is axially displaced in response to a magnetic field generated by current flowing through the coil. The core is drawn into a position where the magnetism can flow completely through the core, as opposed to air. Solenoids are commonly used to cause linear actuation of an attached device. Solenoids are widely used for spark-ignition and compression-ignition engine starting motors, which may be used, for example, in motor vehicle, material handling, marine, generator, and lawn/garden applications.

Solenoids, by virtue of their structure and operation, are susceptible to malfunction due to entry of foreign contaminants. In addition, internal contaminants, such as water vapor and other atmospheric gases, can adversely affect solenoid operation if allowed to accumulate. For example, water condensation on internal solenoid surfaces can result in oxidation of internal solenoid components. Condensation can also cause ice formation on internal components. Solenoid designs must therefore provide adequate protection from external contaminants while minimizing the amount of internal contaminant accumulation.

To cope with the adverse effects of contaminants, conventional solenoids often include air gaps around interface components. Additionally, conventional solenoids sometimes include small-diameter drain tubes and metal screen vents insert molded into the external walls of solenoid components. The injection molding is used to prevent liquid entry around the vents and also to prevent the vents from dislodging.

Conventional solenoid designs may be deficient in several aspects. Typical solenoid designs do not provide an effective and flexible means for allowing internal vapor to escape. Drain tubes, for example, leave the solenoid vulnerable to external contaminant entry. Drain tubes are also limiting in that they are often effective only when located at the bottom of a solenoid. Further, conventional designs do not provide effective control of the vapor transfer rate and the resistance to external contaminant entry. Additionally, insertion molding can be cost prohibitive and is suitable for only limited vent materials.

SUMMARY

Methods, systems, and articles of manufacture consistent with the present invention may obviate one or more of the above and/or other issues. Embodiments of the present invention may improve a solenoid by effectively allowing internal contaminants to exit the solenoid. Embodiments of the present invention may provide a vent that allows vapor to exit a solenoid and that also prevents external contaminants from entering around the vent.

Consistent with the present invention, a vent assembly may be used with an electromechanical solenoid. The vent assembly may include a gasket having an opening that aligns with a vent opening in a cover of the solenoid. The gasket may attach to the solenoid via a counter bore in the cover. The vent assembly may also comprise a vent support, which may include a plurality of support sections. A vent membrane may be interposed between the gasket and the vent support such that contaminants can permeate from within the solenoid through the opening of the gasket to external ambient air.

Consistent with the present invention, the vent support may support the vent membrane and also provide internal ventilation to the vent membrane when attached to the solenoid. The vent support may comprise a plurality of vent support sections shaped such that the sections together form a rim for the vent membrane and provide the ventilation. In addition, the vent support may include a variable diameter support, with a plurality of moveable support sections. The variable diameter vent support may vary from a first diameter larger than an inner diameter of the gasket and larger than an inner diameter of the counter bore into which the gasket is placed to a second diameter smaller than the inner diameter of the gasket.

The foregoing background and summary are not intended to be comprehensive, but instead serve to help artisans of ordinary skill understand the following implementations consistent with the invention set forth in the appended claims. In addition, the foregoing background and summary are not intended to provide any independent limitations on the claimed invention.

BRIEF DESCRIPTION OF THE DRAWINGS

The accompanying drawings show features of implementations consistent with the present invention and, together with the corresponding written description, help explain principles associated with the invention. In the drawings.

DETAILED DESCRIPTION

The following description refers to the accompanying drawings, in which, in the absence of a contrary representation, the same numbers in different drawings represent similar elements. The implementations set forth in the following description do not represent all implementations consistent with the claimed invention. Instead, they are merely some examples of systems and methods consistent with the invention. Other implementations may be used and structural and procedural changes may be made without departing from the scope of present invention.

Figure 1:
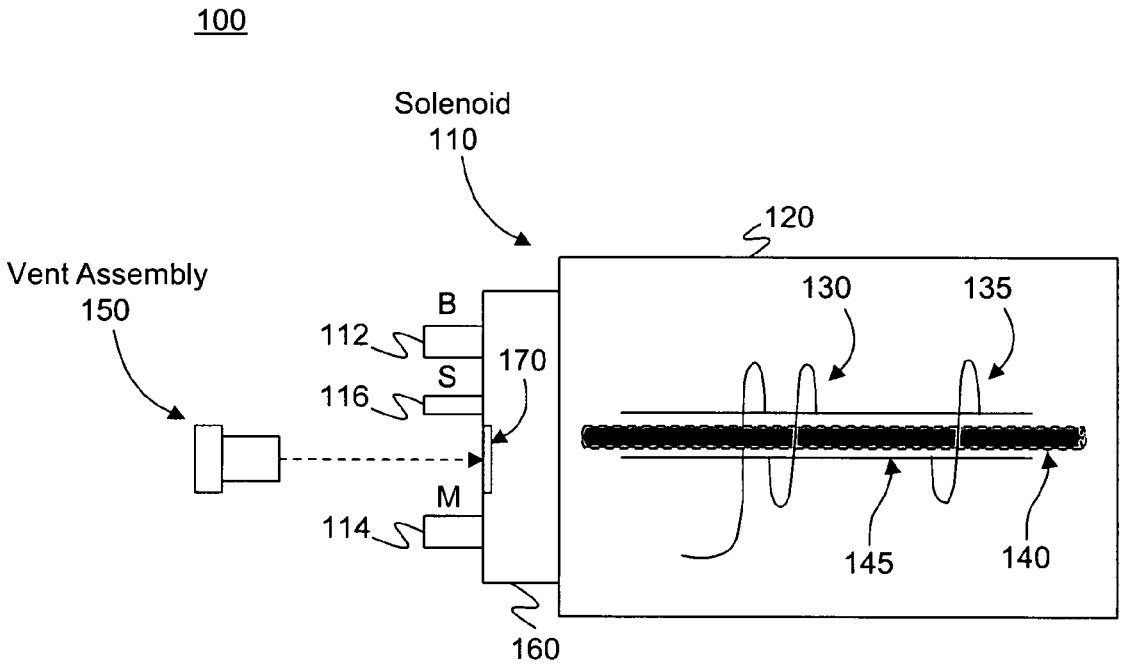
FIG. 1 illustrates an exemplary solenoid assembly consistent with the present invention.

FIG. 1 is a diagram of an exemplary solenoid assembly 100 consistent with the present invention. Solenoid assembly 100 may include a solenoid 110 and a vent assembly 150. When attached to solenoid 110, vent assembly 150 may allow internal contaminants (e.g., water vapor) to exit solenoid 110, while preventing external contaminants from entering solenoid 110.

Figure 6:
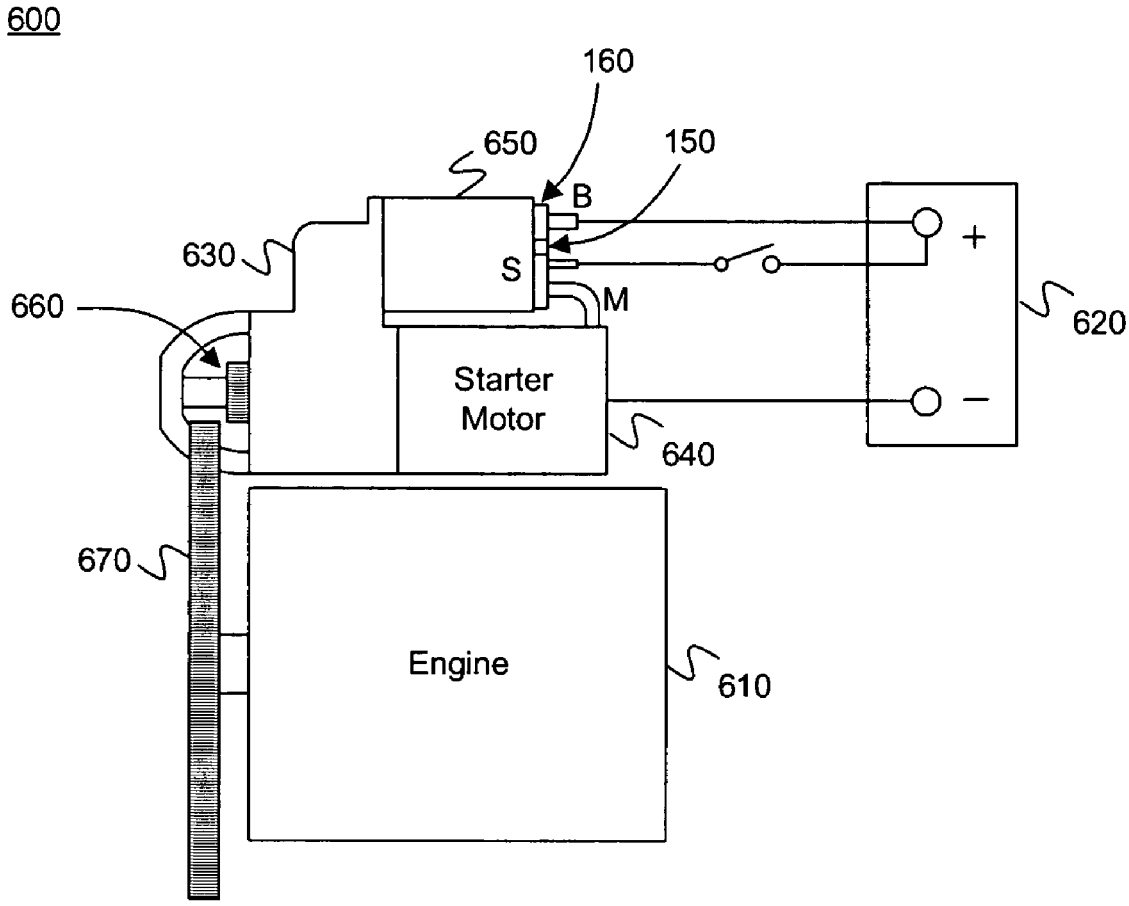
FIG. 6 depicts an exemplary system compatible with the present invention.

Solenoid 110 may comprise one or more terminals or contacts (e.g., terminals 112, 114, and 116) fixed to a housing 120. These terminals may, for example, provide electrical connection points to a motor, voltage source, and a switch. Housing 120 may provide a frame for solenoid 110 and may be made from various materials, such as machined brass, bronze, thermoplasts, stainless steel, nickelized brass, and nickelized bronze. Within housing 120, solenoid 110 may include one or more energizing coils (e.g., pull-in coil 130 and hold-in coil 135). These coils may include any electrically-conductive material known in the art. Solenoid 110 may also include an armature or plunger 140 located in a cylindrical or toroidal casing 145 that shifts axially when the coils are energized. Plunger 140 may constructed to engage a particular device with which solenoid is used, for example a starter assembly. Plunger 140 may include any appropriate ferromagnetic material known in the art, such as iron. Plunger 140 and casing 145 may be constructed such that friction between the two components is minimized. In one example, glass filled nylon and brass could be used for casing 145 and plunger 140 could be coated with a low-friction plating (e.g., nickel). Solenoid 110 may also include a mating cover 160. Mating cover 160 may include a vent opening 170 that corresponds to vent assembly 150. Consistent with the present invention, mating cover 160 may secure vent assembly 150 to solenoid 110. The number of components in solenoid 110 is not critical to the invention and other variations in the number of arrangements of components are possible. Further, solenoid 110 may lack certain illustrated components and/or contain additional or varying components known in the art, such as various seals, springs, valves, pins, etc. Additionally, the solenoid and related starter motor may be conventionally arranged as shown in FIG. 6 or a co-axial assembly, an example of which is illustrated in U.S. Pat. No. 6,633,099.

Figure 2:
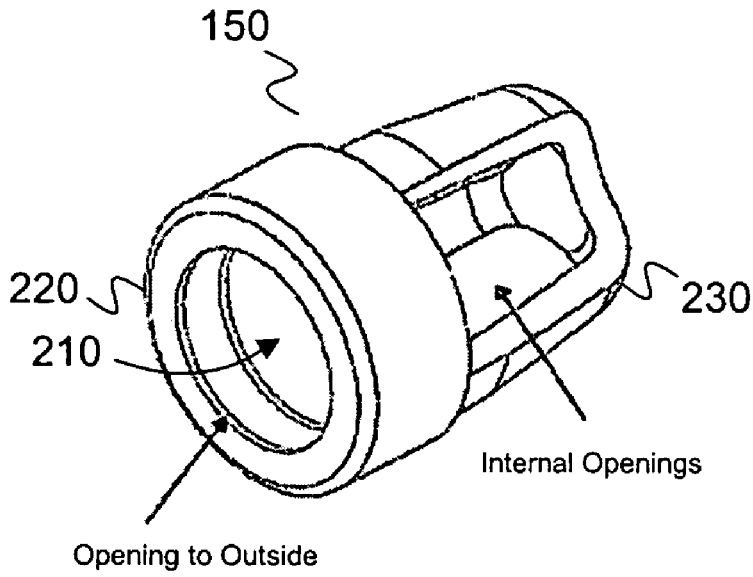
FIG. 2 illustrates an exemplary vent assembly consistent with the present invention.
Figure 3:
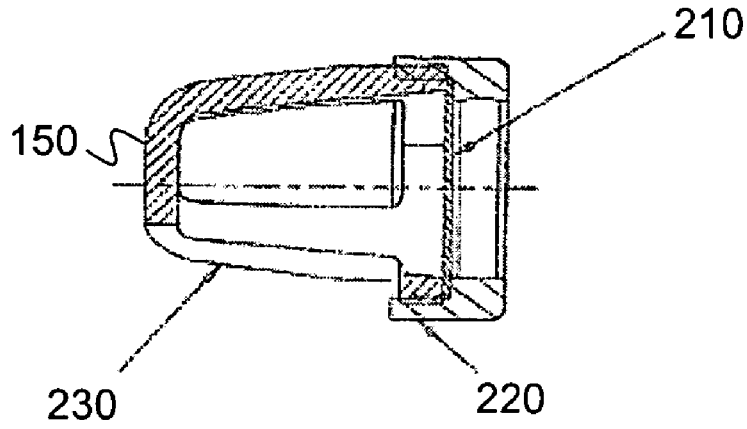
FIG. 3 illustrates a cross-sectional view of an exemplary vent assembly consistent with the present invention

Vent assembly 150 allows internal contaminants (e.g., water vapor) to exit solenoid 110. Vent assembly 150 may also prevent without the use of insertion molding external contaminants from entering solenoid 110 around vent assembly 150. FIG. 2 illustrates an exemplary implementation of vent assembly 150 consistent with the present invention. In the illustrated implementation, vent assembly 150 may comprise a vent 210, a gasket 220, and a support 230. FIG. 3 depicts a cross-sectional view of vent assembly 150. The particular shape and size of vent assembly 150 may be chosen based on the requirements of the application in which it is to be used. As an example, vent assembly 150 may be 14.9 mm in length, with a 12.0 mm diameter.

Vent 210 may represent a membrane through which water vapor and other atmospheric gases can permeate. Consistent with the present invention, vent 210 may serve as a filter for allowing internal contaminants to exit solenoid 110. Vent 210 may include a micro-porous membrane constructed from any suitable material, such as metal fiber. For example, vent 210 may be made of sintered metal fiber media provided by Porvair plc. The particular material, physical size and shape, and pore size of vent 210 may be chosen based on the desired rate of vapor transfer and resistance to liquid entry for the particular application. In one particular configuration, vent 210 may be circular in shape, with a 9.87 mm diameter and 0.34 mm thickness. In addition, vent 210 may sustain, for example, a 5 liter per minute minimum and 25 liter per minute maximum air flow rate, with a 25 inch water (6.22 KPa) pressure differential across the vent. Vent 210 may also be constructed to support, for example, a vertical water column of 20 inches (508 mm) static pressure for 15 minutes without leakage through or around vent 210. Consistent with the present invention, vent 210 may be interposed between gasket 220 and support 230.

Gasket 220 may serve to secure vent 210 and also to prevent external contaminants (e.g., liquid water) from entering solenoid 110. In certain implementations, gasket 220 may be made from a thermoplastic elastomer (TPE) material. The particular material and physical dimensions of gasket 220, however, may be chosen based on vent 210 and other application requirements. Such requirements may include compression and sealing characteristics, shape retention characteristics, resistance to tear, friction coefficients, etc. In one particular implementation, gasket 220 may be circular and made from Santoprene™ rubber, with a diameter of 12.0 mm and wall thickness of 1.85 mm.

As illustrated in FIG. 2, gasket 220 may include an opening in its center that aligns with vent opening 170 in mating cover 160 of solenoid 110. This opening provides a path for water vapor and other atmospheric gases to exit the solenoid (through vent 210) to external ambient air. Consistent with the present invention, gasket 220 may secure vent assembly 210 to mating cover 160 of solenoid 110.

Figure 4:
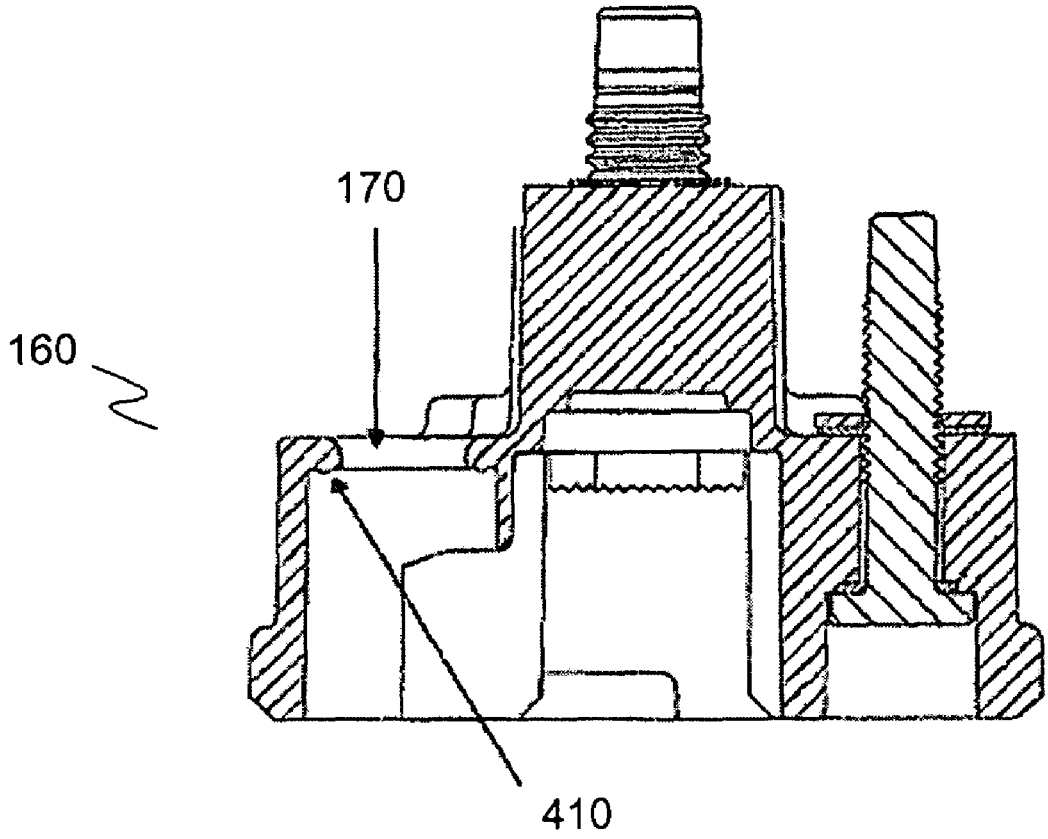
FIG. 4 illustrates a cross-sectional view of an exemplary mating cover consistent with the present invention.

FIG. 4 illustrates a cross-sectional view of an exemplary implementation of mating cover 160. In the illustrated implementation, vent opening 170 of mating cover 160 includes a counter bore 410. Vent opening 170 aligns with the opening in the center of gasket 220 and may be of a shape corresponding to gasket 220. Counter bore 410 in vent opening 170 may capture gasket 220, securing vent assembly 150 inside solenoid 110. Consistent with the present invention, counter bore 410 and the compression of gasket 220 against the inside of vent opening 170 prevents external contaminants from entering solenoid 110 around vent 210 of vent assembly 150, without the use of injection molding.

Figure 5:
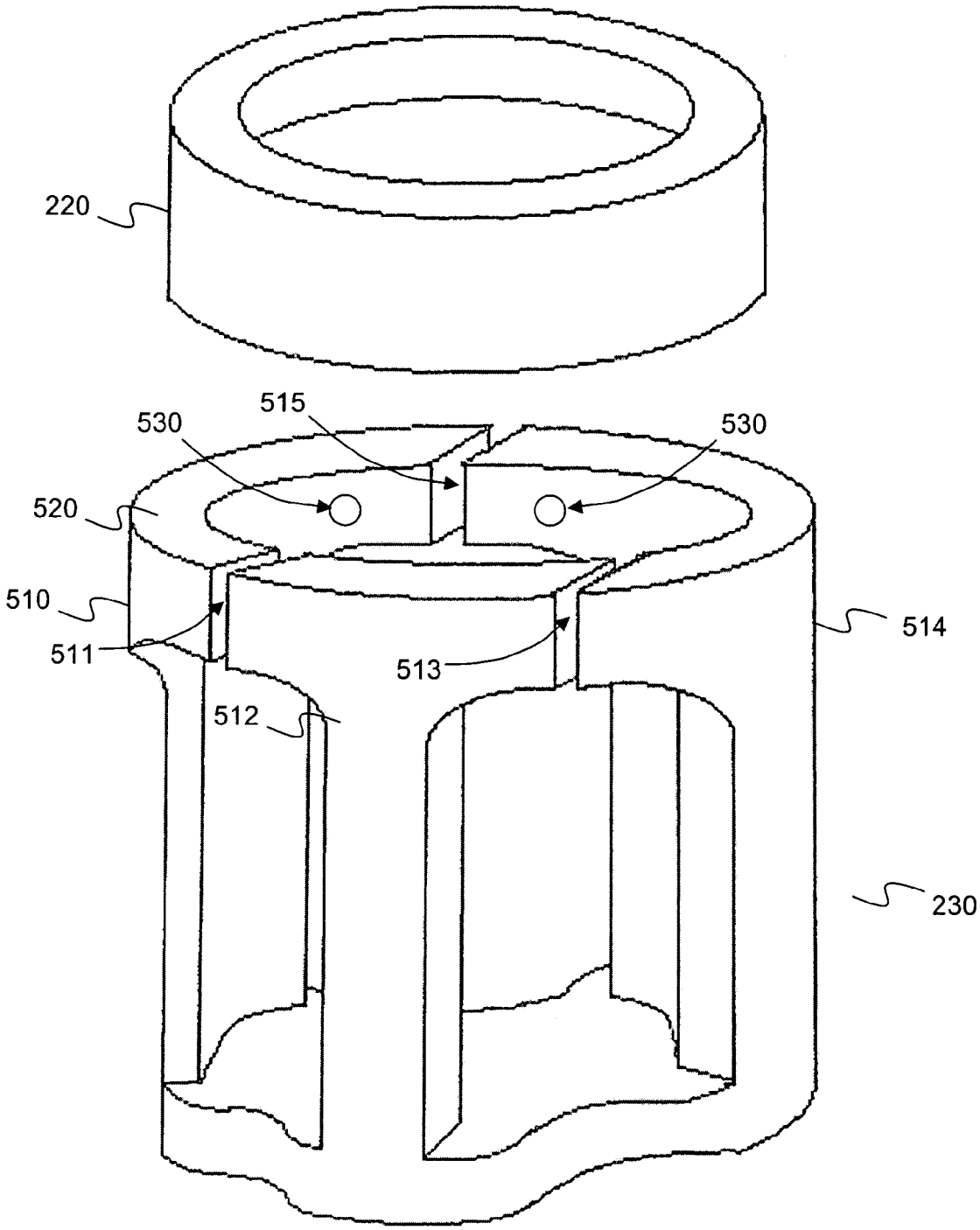
FIG. 5 depicts certain features of a vent assembly consistent with the present invention.

Referring back to FIGS. 2 and 3, support 230 of vent assembly 150 may provide support or a rim (an example of which is illustrated in FIG. 5 at 520) for vent 210 and overall structural integrity for vent assembly 150. Support 230 may be made from thermoplastic material, although other suitable materials may be used depending on the implementation and application requirements. Consistent with the present invention, support 230 may be of variable diameter. As illustrated in FIG. 5, support 230 may include three moveable or flexible fingers (510, 512, and 514)which can alter the diameter of support 230. These fingers may be equidistant from a central axis running through support 230. In one example, fingers 510, 512, and 514 may be spring loaded. Fingers 510, 512, and 514 may be arranged such that, in a relaxed position, a small (e.g., 2-3 mm) gap (511, 513, and 515) exists between each adjacent end of fingers 510, 512, and 514. The end of each of the three finger sections may be off angle to a line formed from the center of support 230 to its perimeter. The top portions of fingers 510, 512, and 514 may form a rim 520 to support vent 210. In addition, the inner portions of fingers 510, 512, and 514 may include one or more extrusions 530, which may prevent vent 210 from falling through the inner diameter of support 230 before installation in solenoid 110.

The variable diameter of support 230 may provide several benefits. For example, it may eliminate potential problems with the walls of gasket 220 collapsing when a fixed diameter support is pressed into the inner diameter of gasket 220. Further, the outward tension on gasket 220 exerted by fingers 510, 512, and 514 may hold gasket 220 in place during shipping and handling and prior to insertion in a solenoid. Also, the outward tension may be utilized to seat vent assembly 150 in mating cover 160 and hold it in place until mating cover 160 is assembled into solenoid 110. In addition, support 230 may be constructed such that the open or relaxed position of fingers 510, 512, and 514 may be larger than the inner diameter of counter bore 412 in mating cover 160. This would ensure that vent assembly 150 is not inserted in mating cover 160 without gasket 220 properly in place.

The fingers of support 230 are not limited to the illustrated "T" shape, and support 230 may include more or less than the illustrated number of fingers. Other appropriate flexible support designs may also be used consistent with the present invention. Moreover, other appropriate rigid support designs without the variable diameter feature of support 230 may be used without departing from the scope of the present invention.

Vent assembly 150 is exemplary and not intended to be limiting. Although illustrated as circular- and cylindrical-shaped, the shape and size of vent 210, gasket 220, and support 230 may vary depending on the particular application. In addition, gasket 220 and support 230 may be formed from the same material and could even be a single component.

FIG. 6 illustrates an exemplary system 600 consistent with the present invention. System 600 may represent, for example, any electro-mechanical system in which a solenoid is used for linear actuation. Non-limiting examples include motor vehicle, material handling, marine, power generator, and lawn/garden systems and subsystems. In the illustrated example, system 600 may comprise an engine 610, a power source 620, and a starter assembly 630. The illustrated components may be coupled via any combination of charge-transporting media. The number of components in system 600 is not limited to what is shown and other variations in the number of arrangements of components are possible, consistent with the present invention. Further, depending on the implementation, elements of system 600 may lack certain illustrated components and/or contain, or be coupled to, additional or varying components not shown.

Engine 610 may, for example, include a spark ignition (e.g., gas-fueled) or compression ignition (e.g., diesel-fueled) internal combustion engine suitable for use in motor vehicles, material handling equipment, marine vessels, power generators, lawn/garden appliances, etc. Power source 620 may include any mechanism capable of storing and/or generating electrical energy. Power source 620 may include, for example, one or more series-connected chemical cells for producing a DC voltage and/or an ultracapacitor. Power source 620 may provide an amount of voltage compatible with the requirement of starter 630, for example, 12V. Starter 630 may include any device, mechanism, or machine capable of cranking engine 610 by way of mechanical force (e.g., rotary motion). Starter 630 may, in one configuration, include a conventional spark ignition or compression ignition starter motor 640 and a solenoid 650. As noted above, solenoid 650 and related starter motor 640 may be conventionally arranged as shown in FIG. 6 or a co-axial assembly, an example of which is illustrated in U.S. Pat. No. 6,633,099.

Solenoid 650 may similar in structure to solenoid 110 described above in connection with FIG. 1. In operation, energizing coils may cause a plunger (not shown) in solenoid 650 to shift in a direction which causes a moveable contact to engage fixed electrical contacts coupled to power source 630 and starter motor 640. This plunger movement may cause a pinion 660 to engage with an engine flywheel 670.

Consistent with the present invention, vent assembly 150 may be coupled to solenoid 650. Vent assembly 150 may allow internal contaminants to exit solenoid 650, while preventing external contaminants from entering solenoid 650 around vent assembly 150. Vent assembly 150 may provide these features without the use of injection molding.

Figure 7:
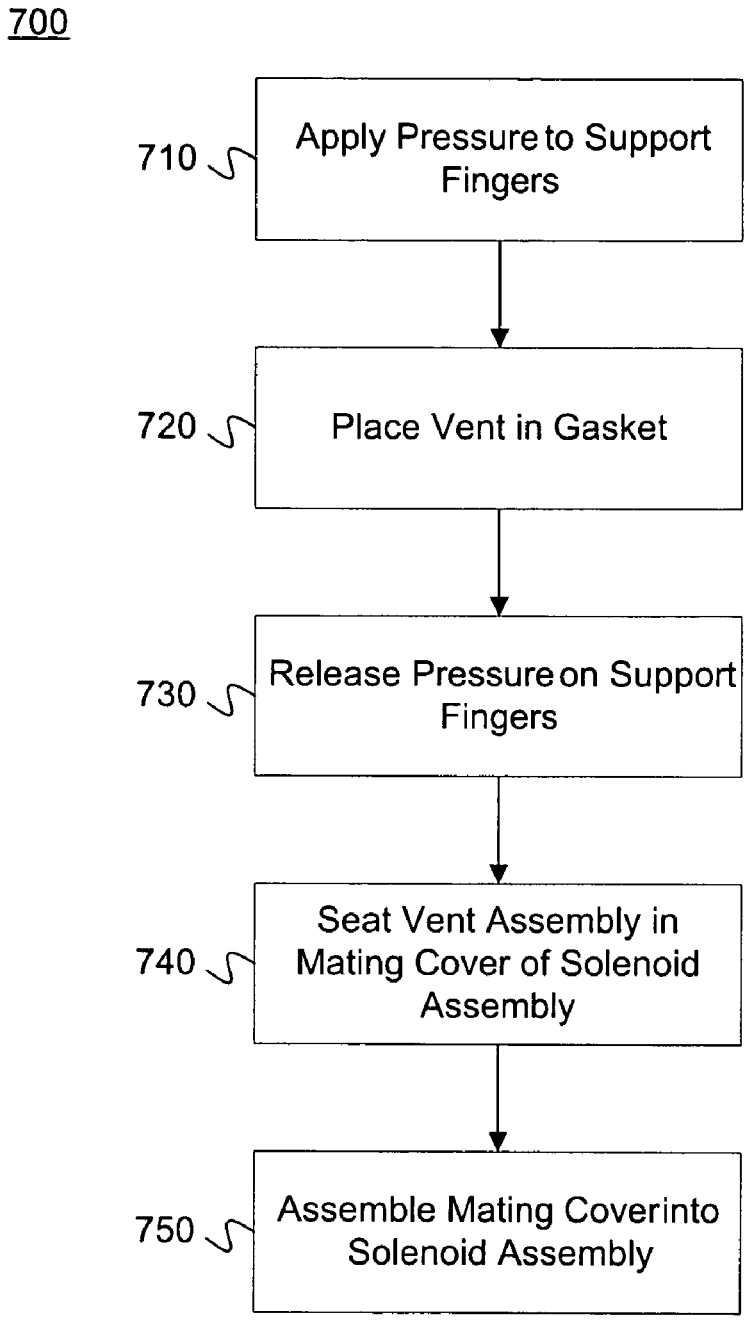
FIG. 7 is a flowchart depicting an exemplary method consistent with the present invention.

FIG. 7 is a flowchart depicting an exemplary method 700 for assembling and installing vent assembly 150 consistent with the present invention. Prior to assembly; support 230 of vent assembly 150 may be in a relaxed position, with fingers 510, 512, and 514 sprung open. Assembly method 700 may begin by applying pressure to support 230 (step 710) along its axis (i.e., squeezing it) so that fingers 510, 512, and 514 come closer together or meet. At this point, the outside diameter at the top of support 230 is smaller than the inner diameter of gasket 220. Vent 210 may then be placed in gasket 220 (step 720). Once vent 210 is placed in the gasket, support 230 is inserted into gasket 220 and the tension on fingers 510, 512, and 514 is released (step 730). The outside perimeter of support 230 formed by fingers 510, 512, and 514 will spring out in response to the tension release to hold gasket 220 and vent 210 securely in place.

Once assembled, vent assembly 150 may be seated in mating cover 160 of solenoid 110 or 650 (step 740). As explained above, extrusions (530) on the inner portions of the support fingers may prevent vent 210 from falling through the inner diameter of support 230 before it is secured in mating cover 160. As also explained above, the open or relaxed position of the support fingers may be larger than the inner diameter of counter bore 410 in mating cover 160 to ensure that vent assembly 150 is not inserted in mating cover 160 without gasket 220. After vent assembly is seated in mating cover 160, the mating cover may be assembled into solenoid 110 (step 750).

FIG. 7 is consistent with an exemplary implementation of the present invention. The sequence of events described in FIG. 7 is exemplary and not intended to be limiting. Other steps may therefore be used, and even with the method depicted in FIG. 7, the particular order of events may vary without departing from the scope of the present invention. Moreover, certain steps may not be present and additional steps may be implemented in method 700. In addition, it should be understood that the stages of FIG. 7 may overlap and/or be modified with departing from the scope of the present invention.

The foregoing description of possible implementations consistent with the present invention does not represent a comprehensive list of all such implementations or all variations of the implementations described. The description of only some implementations should not be construed as an intent to exclude other implementations. Artisans will understand how to implement the invention in the appended claims in may other ways, using equivalents and alternatives that do not depart from the scope of the following claims. Moreover, unless indicated to the contrary in the preceding description, none of the components described in the implementations is essential to the invention.

What is claimed is:

1. A solenoid assembly, comprising:

a housing including an electrical conductor wound around a moveable core;

a mating cover, coupled to the housing, including a vent opening and a counter bore; and a vent assembly for allowing internal contaminants to exit the housing, the vent assembly including:

a gasket having an opening that aligns with the vent opening and that is captured in the counter bore of the mating cover;

a vent support including a plurality of support sections; and a vent membrane interposed between the gasket and the support such that the internal contaminants can permeate from within the housing through the opening of the gasket to external ambient air, wherein the vent support sections are shaped such that the sections together form a rim for the vent membrane and provide ventilation for the vent membrane.

2. The solenoid assembly of claim 1, wherein the gasket includes a circular rubber gasket.

3. The solenoid assembly of claim 1, wherein the vent membrane includes a micro-porous vent membrane.

4. The solenoid assembly of claim 1, wherein the support sections of the vent support are T-shaped.

5. The solenoid assembly of claim 1, wherein the vent support is cylindrically shaped and the support sections flex in response to compression along the central axis of the vent support to provide a variable diameter.

6. The solenoid assembly of claim 5, wherein the variable diameter varies from a first diameter larger than an inner diameter of the gasket and larger than an inner diameter of the counter bore to a second diameter smaller than the inner diameter of the gasket.

7. The solenoid assembly of claim 1, wherein the gasket of the vent assembly is captured in the counter bore of the mating cover such that external contaminants cannot enter the solenoid housing around the vent membrane.

8. The solenoid assembly of claim 7, wherein the gasket of the vent assembly is captured without the use of injection molding in the counter bore of the mating cover such that the external contaminants cannot enter the solenoid housing around the vent membrane.

9. A vent assembly for use with an electro-mechanical solenoid, comprising:

a gasket having an opening that aligns with a vent opening in a cover of the solenoid, wherein the gasket attaches to the solenoid via a counter bore in the cover;

a vent support including a plurality of support sections; and a vent membrane interposed between the gasket and the vent support such that contaminants can permeate from within the solenoid through the opening of the gasket to external ambient air, wherein the vent support sections are shaped such that the sections together form a rim for the vent membrane and provide ventilation for the vent membrane.

10. The vent assembly of claim 9, wherein the gasket includes a circular rubber gasket.

11. The vent assembly of claim 9, wherein the vent membrane includes a micro-porous vent membrane.

12. The vent assembly of claim 9, wherein the support sections of the vent support are T-shaped.

13. The vent assembly of claim 9, wherein the vent support includes a variable diameter vent support.

14. The vent assembly of claim 13, wherein the support sections of the vent support flex in response to compression along the central axis of the vent support to provide the variable diameter.

15. The vent assembly of claim 13, wherein the variable diameter vent support varies from a first diameter larger than an inner diameter of the gasket and larger than an inner diameter of the counter bore to a second diameter smaller than the inner diameter of the gasket.

16. The vent assembly of claim 9, wherein the gasket of the vent assembly is captured by the counter bore such that external contaminants cannot enter the solenoid around the vent membrane.

17. The vent assembly of claim 16, wherein the gasket of the vent assembly is captured without the use of injection molding by the counter bore such that external contaminants cannot enter the solenoid around the vent membrane.

* * * * *